US010457515B2

(12) United States Patent
Hagi

(10) Patent No.: US 10,457,515 B2
(45) Date of Patent: Oct. 29, 2019

(54) PAPER CONVEYANCE MECHANISM

(71) Applicant: STAR MICRONICS CO., LTD., Shizuoka (JP)

(72) Inventor: Yasuhiko Hagi, Shizuoka (JP)

(73) Assignee: STAR MICRONICS CO., LTD., Shizuoka-Shi (JP)

( * ) Notice: Subject to any disclaimer, the term of this patent is extended or adjusted under 35 U.S.C. 154(b) by 232 days.

(21) Appl. No.: 15/404,390

(22) Filed: Jan. 12, 2017

(65) Prior Publication Data

US 2017/0121142 A1 May 4, 2017

Related U.S. Application Data

(63) Continuation of application No. PCT/JP2015/070823, filed on Jul. 22, 2015.

(30) Foreign Application Priority Data

Aug. 12, 2014 (JP) ..... 2014-164604

(51) Int. Cl.
*B65H 23/34* (2006.01)
*B41J 15/04* (2006.01)
(Continued)

(52) U.S. Cl.
CPC ..... *B65H 23/34* (2013.01); *B41J 11/0005* (2013.01); *B41J 15/04* (2013.01);
(Continued)

(58) Field of Classification Search
CPC ..... B65H 23/34; B65H 23/005; B65H 2301/51256; B65H 2511/142; B65H 5/36;
(Continued)

(56) References Cited

U.S. PATENT DOCUMENTS 1,654,946 A 1/1928 Sinks
1,807,274 A 5/1931 Beidler
(Continued)

FOREIGN PATENT DOCUMENTS

EP 0341970 11/1989
GB 1360191 7/1974
(Continued)

OTHER PUBLICATIONS

Itakura, Toshiji; JP2006225139—Translation; Published: Aug. 31, 2006 (Year: 2006).*
(Continued)

*Primary Examiner* — Michael R Mansen
*Assistant Examiner* — Raveen J Dias
(74) *Attorney, Agent, or Firm* — Lex IP Meister, PLLC

(57) ABSTRACT

The invention provides a paper conveyance mechanism capable of curl correction of paper drawn out from roll paper according to the intensity of curl. The paper conveyance mechanism comprises an ironing part for correcting paper curl which is brought into contact with an outer surface of the paper, a pressing part which presses the paper from one side to bend the paper at the ironing part, and an arm engaged with an outer circumferential surface of the roll paper to be operated according to a change in a roll diameter. An upstream-side pressing part is moved from the one side toward the other side in association with an operation of the arm during at least part of a period of the operation of the arm to reduce an ironing angle formed in the paper bent at the ironing part according to a decrease in the roll diameter.

20 Claims, 11 Drawing Sheets

(51) Int. Cl.
*B65H 23/00* (2006.01)
*B41J 11/00* (2006.01)

(52) U.S. Cl.
CPC ..... *B41J 15/042* (2013.01); *B65H 23/005* (2013.01); *B65H 2301/51256* (2013.01); *B65H 2511/142* (2013.01)

(58) Field of Classification Search
CPC ..... B65H 29/52; B65H 2301/5125; B65H 2301/51254; B65H 2301/512565; B41J 11/0005; B41J 15/04; B41J 15/042; G03G 15/6576
USPC ..... 242/615.3, 548, 615.24, 566
See application file for complete search history.

(56) References Cited

U.S. PATENT DOCUMENTS 3,604,652 A * 9/1971 Sleeper ..... B65H 23/34 242/419.2
5,009,749 A * 4/1991 Cederholm ..... B65H 23/34 162/197
5,413,426 A * 5/1995 Ijuin ..... B41J 11/0005 346/24
5,450,102 A * 9/1995 Ishida ..... B41J 11/0005 346/136
5,533,821 A * 7/1996 Awai ..... B41J 15/042 347/219
5,566,906 A * 10/1996 Kamada ..... B65H 23/34 226/196.1
5,717,836 A * 2/1998 Horie ..... B41J 11/0005 358/1.1
8,240,929 B2 * 8/2012 Kohyama ..... B41J 11/0045 400/613
2003/0103132 A1 * 6/2003 Oshima ..... B65H 23/34 347/153
2004/0119807 A1 * 6/2004 Fujiwara ..... B41J 11/0005 347/218
2007/0248396 A1 * 10/2007 Blanchard, Jr. ..... B41J 3/4075 400/619
2008/0252000 A1 * 10/2008 Dochi ..... B41J 11/0005 271/264
2009/0190984 A1 * 7/2009 Yamamoto ..... B41J 11/0005 399/406

FOREIGN PATENT DOCUMENTS

JP S49-106346 9/1974
JP S58-188254 11/1983
JP 60-56650 4/1985
JP S61-64655 4/1986
JP 03-78365 8/1991
JP 05208765 8/1993
JP 05-68999 9/1993
JP 2910345 6/1999
JP 2004-051009 2/2004
JP 2006-225139 8/2006

OTHER PUBLICATIONS

EPO, Supplementary Search Report of Application No. 15831786.7, Feb. 23, 2018.
SIPO, Office Action of CN 201580042963.0 dated Sep. 1, 2017.

* cited by examiner

PAPER CONVEYANCE MECHANISM

CROSS-REFERENCE TO RELATED APPLICATION

This application is a continuation of International Patent Application No. PCT/JP2015/070823, filed on Jul. 22, 2015, which claimed priority of Japanese Patent Application No. 2014-164604 filed on Aug. 12, 2014. The contents of these applications are incorporated herein by reference in their entirety.

BACKGROUND

(a) Field

The present invention relates to a paper conveyance mechanism capable of conveying paper drawn out from roll paper.

(b) Description of the Related Art

A paper conveyance mechanism capable of conveying paper drawn out from roll paper formed by long continuous paper wound in a roll shape is conventionally used in a printer or a facsimile as shown in Japanese Patent Application Publication No. 2004-51009. The paper conveyance mechanism includes a platen roller and an idler roller disposed between the platen roller and the roll paper. A printing head is disposed opposite the platen roller. Generally, as in the printer or the facsimile as disclosed in Japanese Patent Application Publication No. 2004-51009, a leading end of paper is manually pulled from the roll paper set in a position and inserted between the platen roller and the printing head. The paper drawn out from the roll paper is thereby conveyed in a predetermined conveying direction as the platen roller is rotated. The paper is printed by the printing head and then cut by a cutter into a piece of paper to be discharged as a receipt or others.

SUMMARY

The compact roll paper used in the conventional paper conveyance mechanism occupies very little space, but paper wound in a roll shape is curled and a piece of paper cut from the roll paper to be issued as a receipt or others is thereby curled. A curl of paper is hardly handled and looks bad. A store clerk often tries for curl correction by longitudinally folding or pulling the piece of paper for a customer to easily sign the credit receipt, which is a troublesome trial. Further, the intensity of paper curl is not constant but varied according to the diameter of the roll paper. The intensity is increased according to a decrease in the roll diameter. Only applying constant force would therefore result in unsatisfactory correction or even in a reverse curl generation.

The present invention is to provide a paper conveyance mechanism capable of curl correction of paper drawn out from roll paper according to the intensity of curl.

The paper conveyance mechanism capable of conveying paper drawn out from roll paper formed by long continuous paper wound in a roll shape with a surface of the paper on one side inside and another surface of the paper on the other side outside comprises an ironing part for correcting paper curl which is brought into contact with the surface of the paper on the other side while the paper is conveyed, a pressing part which presses the surface of the paper from the one side to bend the paper at the ironing part, and an arm engaged with an outer circumferential surface of the roll paper to be operated according to a change in a roll diameter of the paper roll. The pressing part is moved from the one side toward the other side in association with an operation of the arm during at least part of a period of the operation of the arm to reduce an interior angle formed in the paper bent at the ironing part according to a decrease in the roll diameter.

The interior angle is an angle formed by the surface of the paper on the other side on the upstream side of the ironing part and the surface of the paper on the other side on the downstream side of the ironing part. The arm may be operated in engagement with the outer circumferential surface of the roll paper according to a change in a roll diameter of the paper roll only when the roll diameter is within a predetermined range. The operation of the arm may be stopped when the roll diameter falls below the predetermined diameter.

The paper is pressed by the pressing part from the one side to be ironed by the ironing part. The pressing part is moved in association with the arm in a manner to reduce the interior angle according to a decrease in the roll diameter. Ironing force to correct paper curl is increased according to a reduction in the interior angle. Such ironing force may be referred to as correction force. In the invention, correction force can be increased by reducing the interior angle according to an increase in the intensity of curl due to a decrease in the roll diameter. The paper is thereby corrected according to the intensity of curl.

The pressing part is preferably stopped to move when the roll diameter is above an upper limit setting value or below a lower limit setting value smaller than the upper limit setting value. The pressing part is preferably moved in association with the operation of the arm when the roll diameter is the upper limit setting value or less and the lower limit setting value or more.

The intensity of curl is decreased according to an increase in the roll diameter. Curl correction may be therefore not required as far as the roll diameter is as large as the predetermined size. The maximum roll diameter requiring curl correction may be set as the upper limit setting value. The operation of the first pressing part may be stopped as far as the roll diameter is larger than the upper limit setting value. Curl correction force is thereby suppressed until the roll diameter reaches the upper limit setting value. Though the intensity of curl is increased as the roll diameter is decreased, reducing the interior angle too much would possibly cause a problem of an excess of friction load on the paper. In the invention, when the roll diameter is decreased below the lower limit setting value, movement of the first pressing part F1 is stopped to still apply proper correction force. Applying correction force than is needed would also cause a problem of reverse curling. The invention prevents the problems of friction force and reverse curling.

The pressing part may be moved from the one side toward the other side in association with the operation of the arm to reduce the interior angle according to the decrease in the roll diameter when the roll diameter is a contact setting value or less and the lower setting value or more, the contact setting value being below the upper limit setting value.

Accordingly, when the roll diameter is above the contact setting value and the upper limit setting value or less (non-variable period), the interior angle is not varied while the pressing part is moved in association with the operation of the arm. In the non-variable period, the pressing part is not allowed to move to reduce the interior angle.

The paper in contact with the ironing part is likely bent while paper conveyance is continuously suspended.

The paper conveyance mechanism may further comprise an accommodating space provided opposite the ironing part with respect to the paper to accommodate part of the paper and a reversely conveying unit which reversely feeds the paper in a manner to make a loop in the accommodating space.

The reversely conveying unit makes a loop of paper in the accommodating space, thereby releasing tension and separating the paper from the ironing part. The paper is thereby prevented from being bent even when the standby condition continues.

Curl correction force applied to the paper is varied according to the conveying speed. Curl correction force is greater as the conveying speed is slower.

The paper conveyance mechanism may further comprise a conveying unit configured to convey the paper, a detecting unit configured to detect the roll diameter of the roll paper, and a control unit configured to control conveying speed of the paper conveyed by the conveying unit according to the roll diameter detected by the detecting unit. The control unit may decrease the conveying speed when the roll diameter is reduced below a predetermined diameter.

The control unit may continuously or stepwise decrease the conveying speed according to a decrease in roll diameter.

When the roll diameter is reduced below the presetermined size, the conveying speed may be decreased to increase curl correction force.

The present invention provides a paper conveyance mechanism capable of curl correction of paper drawn out from roll paper according to the intensity of curl.

DETAILED DESCRIPTION

Figure 1A:
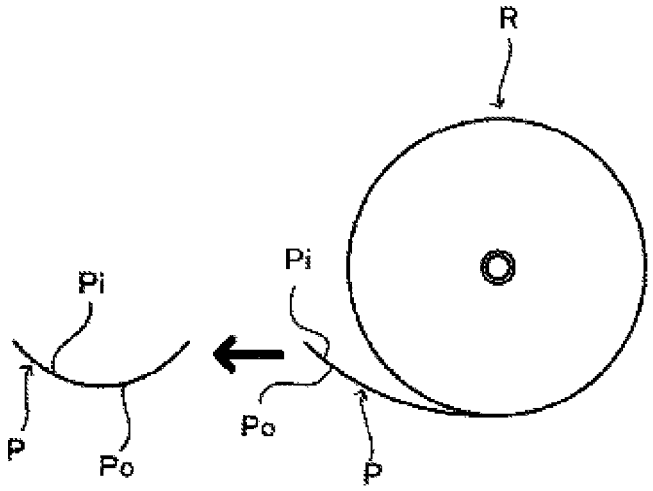
FIG. 1A and FIG. 1B respectively shows how paper drawn out from roll paper curls.

An embodiment of the present invention is being described referring to the drawings. The paper conveyance mechanism of the invention can be applied to various apparatuses with and without printing function including a printer and a facsimile conveying paper drawn out from roll paper. The paper conveyance mechanism of the invention is being technologically described referring to FIG. 1A, FIG. 1B and FIG. 2.

Figure 1B:
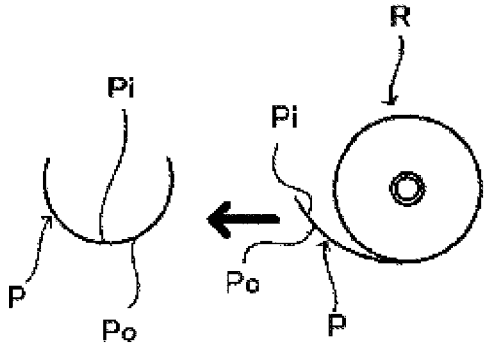
Figure 2:
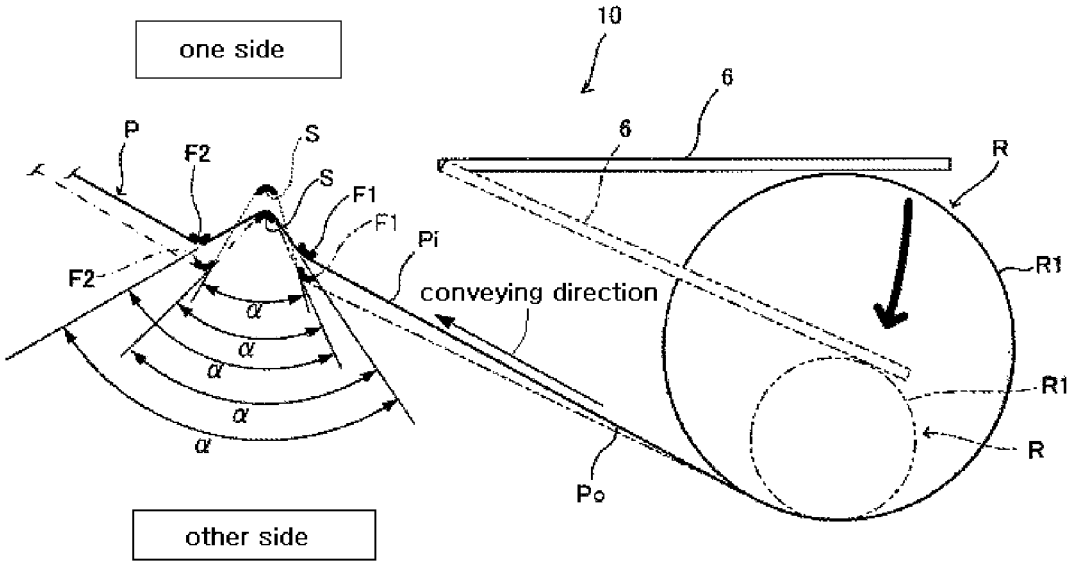
FIG. 2 shows curl correction technology in a paper conveyance mechanism of the present invention.

FIG. 1A and FIG. 1B respectively schematically shows how paper drawn out from roll paper curls and how a piece of paper cut from the roll paper curls. FIG. 2 shows curl correction technology in a paper conveyance mechanism 10 of the invention.

As shown in FIG. 1A, roll paper R is formed by long continuous paper wound in a roll shape with one surface of the paper inside and the other surface of the paper outside. Hereinafter, the one surface of the paper may be referred to as an inner surface Pi while the other surface as an outer surface Po. Paper wound in a roll shape likely curls. A piece of paper of a predetermined length separated from the roll paper curls with the inner surface Pi inside. As shown in FIG. 1B, the intensity of curl is increased as the roll diameter is decreased. A piece of paper cut from the roll paper of smaller diameter curls with greater intensity.

As shown in FIG. 2, the paper conveyance mechanism 10 includes an ironing part S, an upstream-side pressing part F1, a downstream-side pressing part F2, and an arm 6. Paper P from the roll paper R is conveyed upward to the left as shown in a thin straight arrow. The upstream-side pressing part F1, the ironing part S, and the downstream-side pressing part F2 are arranged in the order toward the downstream side on a conveying path. The ironing part S is in contact with the outer surface Po of the paper P. Hereinafter, the side of the inner surface Pi may be referred to as the one side while the side of the outer surface Po as the other side. The upstream-side pressing part F1 is disposed on the upstream side of the ironing part S to press the paper P from the one side. The downstream-side pressing part F2 is disposed on the downstream side of the ironing part S to press the paper P from the one side. The combination of the upstream-side pressing part F1 and the downstream-side pressing part F2 is an example of a pressing part of the invention. The pressing part may be constituted by any one of them.

The arm 6 is movable according to a change in diameter of the roll paper R. Operation of the arm 6 is not limited to the embodiment. In FIG. 2, one end of the arm 6 is in contact with the outer circumferential surface R1 of the roll paper R so as to pivot downward as shown in a bold arc arrow as the roll diameter decreases. The upstream-side pressing part F1 is interlocked with the arm 6 via a not-shown linking mechanism to be thereby shifted from the one side to the other side as the arm 6 pivots as the roll diameter decreases. Instead, the downstream-side pressing part F2 may be interlocked with the arm 6. Both of the pressing parts F1 and F2 may be interlocked with the arm 6.

The paper P is bent by the ironing part S and the pressing parts F1 and F2 into a predetermined angle at a portion thereof in contact with the ironing part S. The predetermined angle is an interior angle of the invention, which is an angle formed by the other surface of the paper P on the upstream side of the ironing part S and the other surface on the downstream side of the ironing part S. Hereinafter, the interior angle may be referred to as an ironing angle $\alpha$. The paper P bent at the ironing angle $\alpha$ is ironed by the ironing part S for curl correction when passed therethrough. Correction force applied to the paper P depends on the ironing angle $\alpha$. The correction force is increased as the ironing angle $\alpha$ is decreased.

As shown in a two-dot chain line in FIG. 2, when the arm 6 is moved as the roll diameter is decreased, the upstream-side pressing part F1 is accordingly moved from the one side to the other side by the not-shown linking mechanism. The ironing angle α becomes thereby smaller resulting in generation of greater correction force. Instead, the downstream-side pressing part F2 may be accordingly moved from the one side to the other side to reduce the ironing angle α as shown in a dashed line. Further instead, both of the upstream-side pressing part F1 and the downstream-side pressing part F2 may be accordingly moved from the one side to the other side to reduce the ironing angle α as shown in the two-dot chain line and the dashed line. Further, the ironing part S may be urged toward the one side to be shifted to the one side when tension applied to the conveyed paper P in the conveying direction is reduced as the roll diameter is reduced. The ironing angle α can be made further smaller as the roll diameter is reduced as shown in a broken line. The above described configuration enables paper curl correction force to be adjusted according to the intensity of curl. Specifically, the ironing angle α is decreased to increase the paper curl correction force as the roll diameter is reduced to make the intensity of curl greater. At least one of the upstream-side pressing part F1 and the downstream-side pressing part F2 is interlocked with the arm 6 to be shifted from the one side to the other side thereby decreasing the the ironing angle α as the roll diameter is reduced.

Figure 3A:
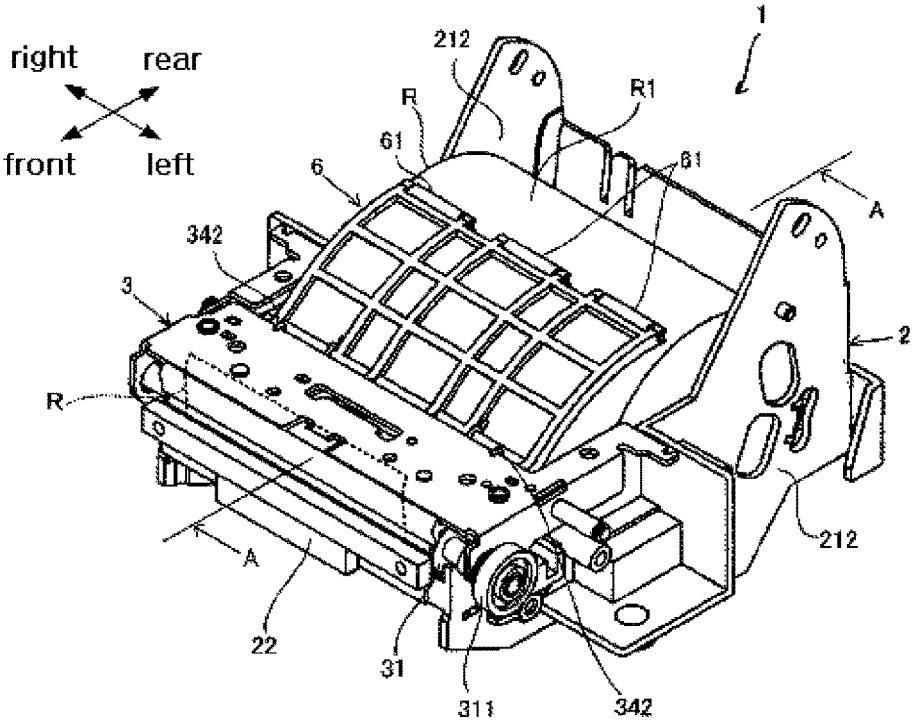
FIG. 3A is a front perspective view of a printer of an embodiment from the obliquely upward right.
Figure 3B:
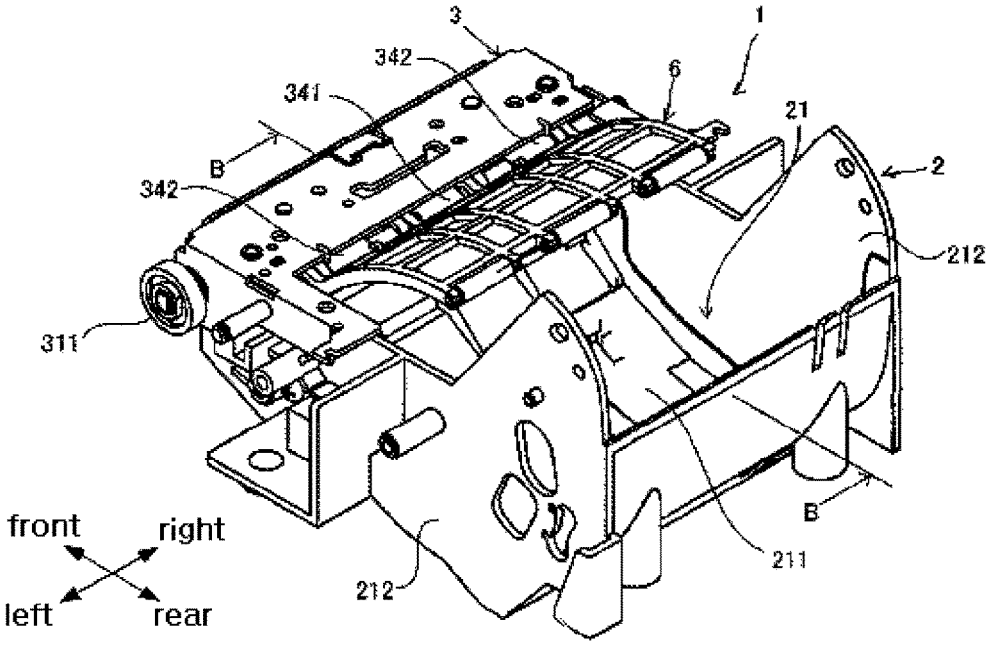
FIG. 3B is a rear perspective view of the printer from the obliquely upward left.
Figure 4A:
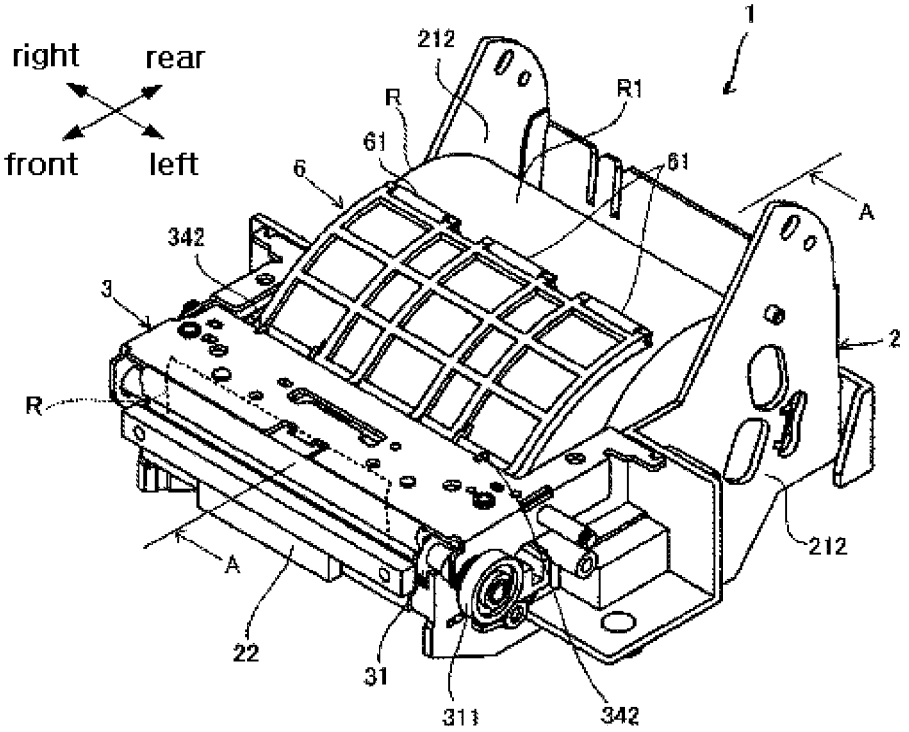
FIG. 4A is an A-A line sectional view of the printer of FIG. 3A.
Figure 4B:
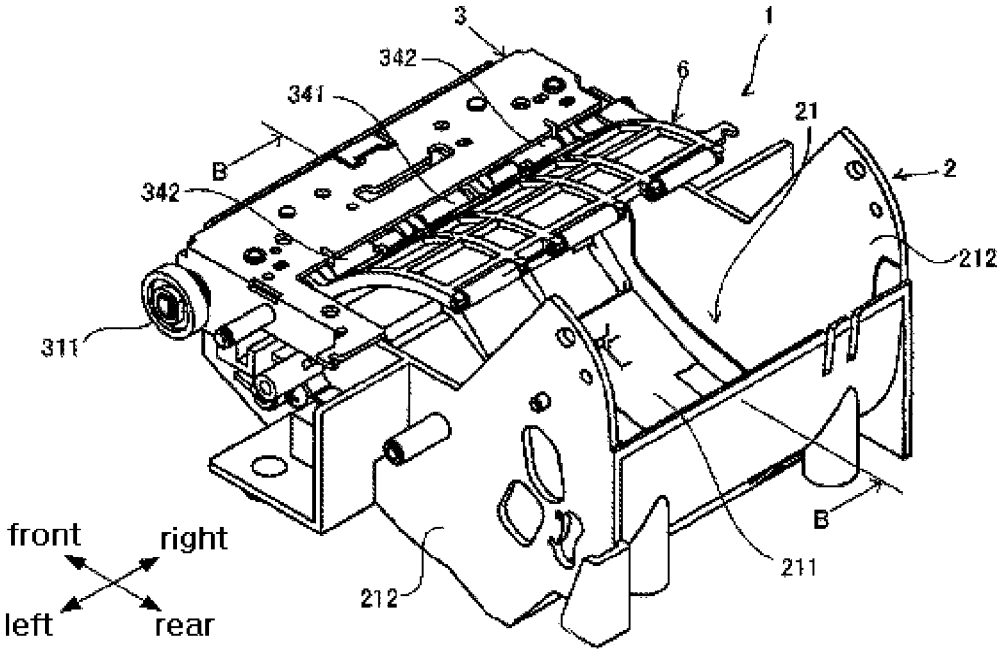
FIG. 4B is a B-B line sectional view of the printer of FIG. 3B.

In the case the ironing part S is circular-arc shaped, curl correction force is varied according to the radius of the ironing part S. Specifically, curl correction force is greater as the radius is smaller. Curl correction force is also varied according to the conveying speed of paper P. Specifically, curl correction force is greater as the speed is slower. Adjustment of curl correction force is available by the combination of the radius of the ironing part S and the paper conveying speed in addition to the ironing angle α. Based on the explanation above referring to FIG. 1A, FIG. 1B and FIG. 2, an embodiment of the invention applied to a printer is being described FIG. 3A is a front perspective view of a printer 1 of the embodiment from the obliquely upward right. FIG. 3B is a rear perspective view of the printer 1 from the obliquely upward left. The printer 1 is enclosed by a not shown housing constituted by, for example, a body case, a rear cover, and front cover. FIG. 3 shows the internal structure of the printer 1. FIG. 4A is an A-A line sectional view of the printer 1 of FIG. 3A. FIG. 4B is a B-B line sectional view of the printer 1 of FIG. 3B.

The printer 1 is a thermal printer adapted to accommodate roll paper R formed by long continuous thermal paper wound in a roll shape and to print numbers and letters on paper drawn out from the lower side of the roll paper R, and then to cut the paper into a piece of paper to be discharged. The roll paper R is accommodated in FIG. 3A and FIG. 4A while removed in FIG. 3B and FIG. 4B. The obliquely downward left is the front side and the obliquely upward right is the rear side in FIG. 3A and FIG. 4A while the obliquely upward left is the front side and the obliquely downward right is the rear side in FIG. 3B and FIG. 4B. In the explanation below, the front and rear directions may be referred based on the assembly manner of parts in the printer 1.

The printer 1 comprises a paper holder 2 and a platen holder 3. The paper holder 2 includes a paper accommodating part 21 for the roll paper R. The paper accommodating part 21 includes a paper supporting part 211 and a pair of side walls 212. The paper holder 2 is provided with a printing head 22. The platen holder 3 constituting part of the not-shown rear cover is provided with a platen roller 31, an upstream-side guide 32, and a downstream-side guide 33, and the arm 6. The roll paper R is set in the paper accommodating part 21 with the not-shown rear cover opened. In FIG. 3A and FIG. 4A, paper P drawn out from the roll paper R is shown in a broken line. The leading end of the paper P reaches the end of a paper conveying path in FIG. 4A. The direction from the paper accommodating part 21 toward the leading end of the paper P is a paper conveying direction. A not-shown paper discharge port is formed by the not-shown rear and front covers at the neighborhood of the leading end of the paper P. The paper conveying path starts from the roll paper R and ends at the paper discharge port while the paper conveying direction is the direction toward the paper discharge port.

As shown in FIG. 4A and FIG. 4B, a decurling unit 5 provided with the ironing part S is disposed on the downstream side of the paper accommodating part 21. The decurilng unit 5 includes a base 51 fixed to the paper holder 2 so as to extend in the right and left direction and a rib 52 protruding upward from the base 51. The rib 52 is extended in the right and left direction similarly. A plurality of reinforcement parts 521 are provided in the right and left direction at a certain intervals on the base 51 and the rib 52. The ironing part S is provided on the distal end of the rib 52.

The platen roller 31 is extended in the right and left direction opposite the printing head 22. The platen roller 31 is provided with a platen gear 311 for transmitting rotational force from a not-shown paper conveying motor to the platen roller 31. Further, a cutter unit 23 and a fixed blade 35, as described later referring to FIG. 5A and FIG. 5B, are disposed on the downstream side of the platen roller 31 and the printing head 22.

The roll paper R is set in the paper accommodating part 21 and the leading end of the paper P is pulled outside the printer 1 before the rear cover is closed. By closing the rear cover, the platen roller 31 is brought into contact with the printing head 22 with proper pressure and the paper P is thereby pinched by the platen roller 31 and the printing head 22. The pinched paper P is conveyed in the paper conveying direction by friction force generated between the platen roller 31 and the printing head 22 as the platen roller 31 is driven. Paper P can be reversely conveyed toward the upstream side by reversely driving the platen roller 31. The paper P is printed with numbers and letters by the printing head 22 and cut into a piece of paper of a certain length by the cutter unit 23 (FIG. 5).

The downstream-side guide 33 is disposed on the upstream side of the platen roller 31. The downstream-side guide 33 is provided with the downstream-side pressing part F2 (FIG. 2) and fixed to the platen holder 3. The upstream-side guide 32 is disposed on the upstream side of the downstream-side guide 33. The upstream-side guide 32 is provided with the upstream-side pressing part F1 (FIG. 2). The upstream-side guide 32 is rotatably mounted on a shaft 34 extended in the right and left direction to be thereby rotatable on the shaft 34. The arm 6 is also rotatably mounted on the shaft 34. The arm 6 is a curved plate extending in the front and back direction and having a grid-shaped reinforcing rib on the surface thereof. The arm 6 is fixed to the shaft 34 on one end thereof while on the other end thereof a contact roller 61 is provided. Three torsion springs inserted in the shaft 34 are arranged in the right and left direction. The center torsion spring is a first torsion spring 341 and each of the side torsion springs is a second torsion spring 342. The upstream-side guide 32 is urged in a counter-clockwise direction around the shaft 34 by the first torsion spring 341 when viewed from the left side. Accordingly, the upstream-side pressing part F1 is urged toward the one side in FIG. 2. The upstream-side pressing part F1 is thereby urged toward the direction away from the paper P. The arm 6 is urged in a clockwise direction around the shaft 34 by the second torsion springs 342 when viewed from the left side. The contact roller 61 is thereby in contact with the outer circumferential surface R1 of the roll paper R. The arm 6 is rotated in a clockwise direction when viewed from the left side according to the change in diameter of the roll paper R with the contact roller 61 kept in contact with the outer circumferential surface R1 regardless of the change in roll diameter.

Figure 5A:
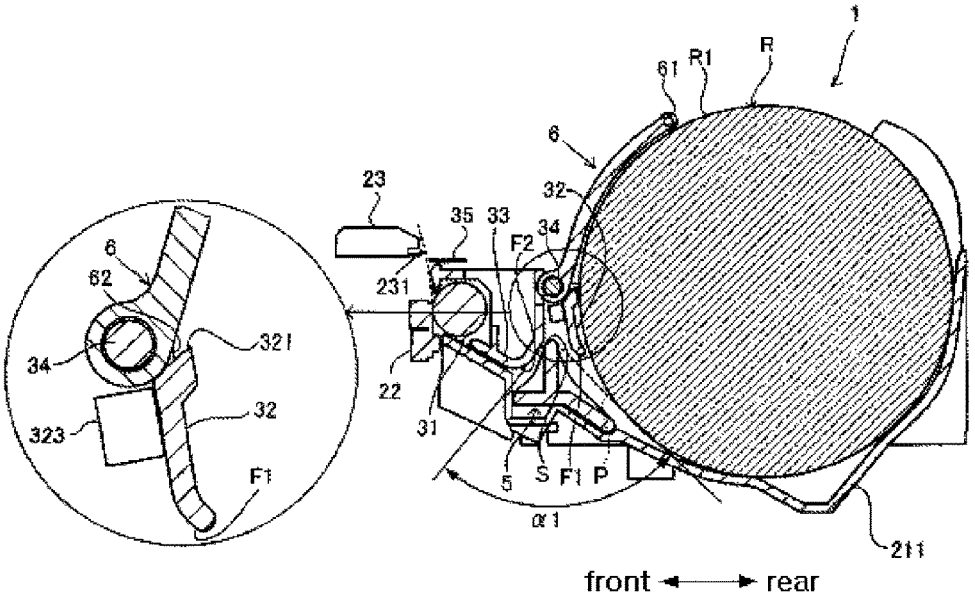
FIG. 5A and FIG. 5B respectively shows how an arm is rotated in the clockwise direction according to a change in roll diameter of paper.
Figure 5B:
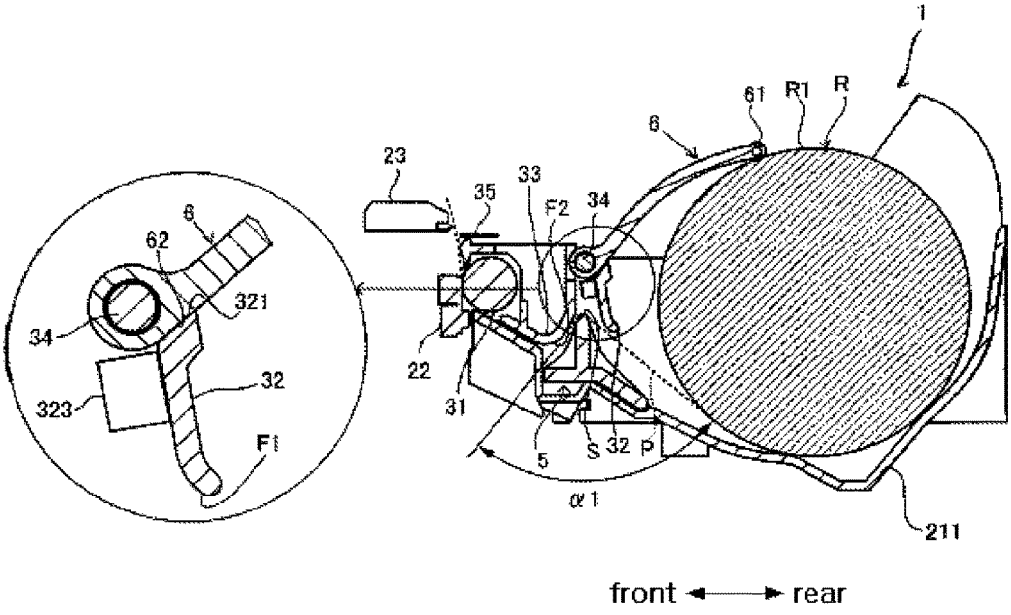
Figure 6A:
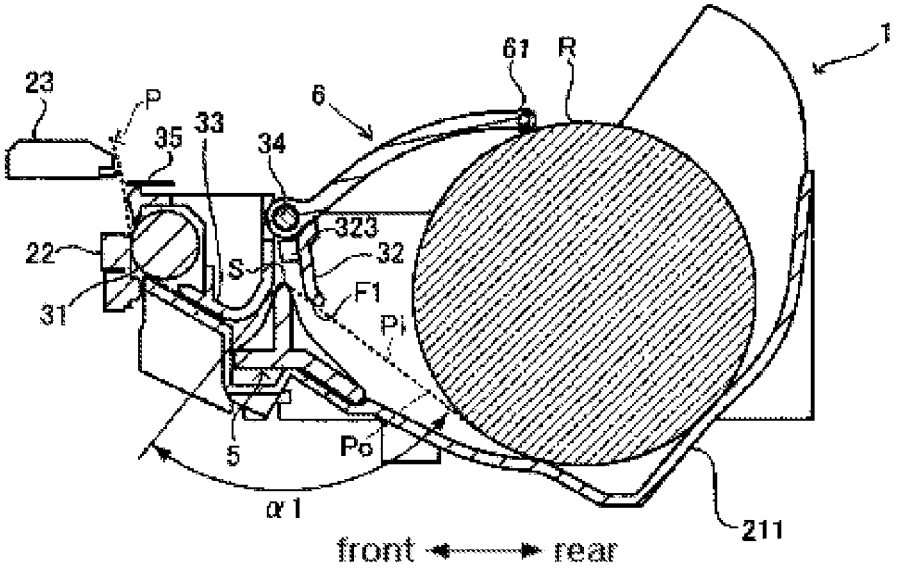
FIG. 6A, FIG. 6B, and FIG. 6C respectively shows how an ironing angle is varied according to the change in roll diameter of paper.
Figure 6B:
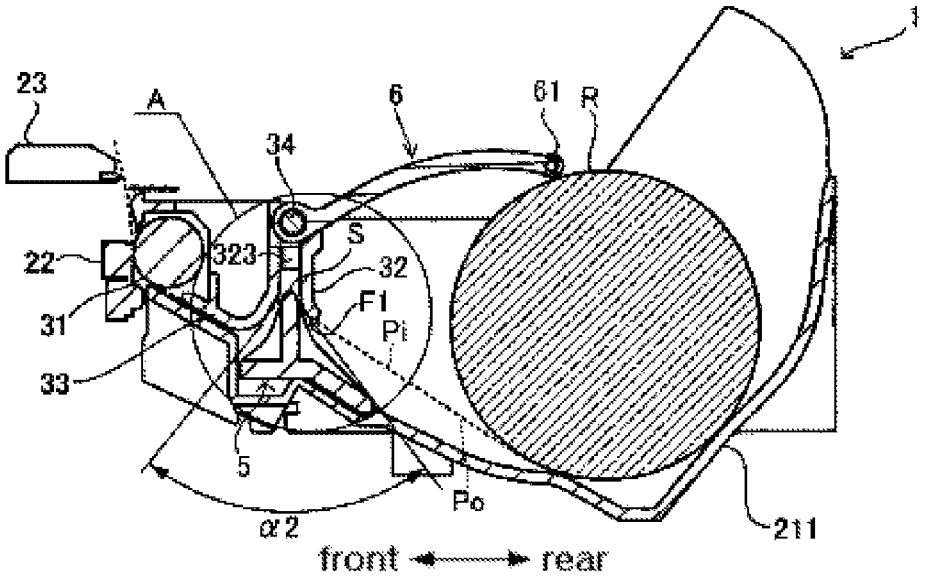
Figure 6C:
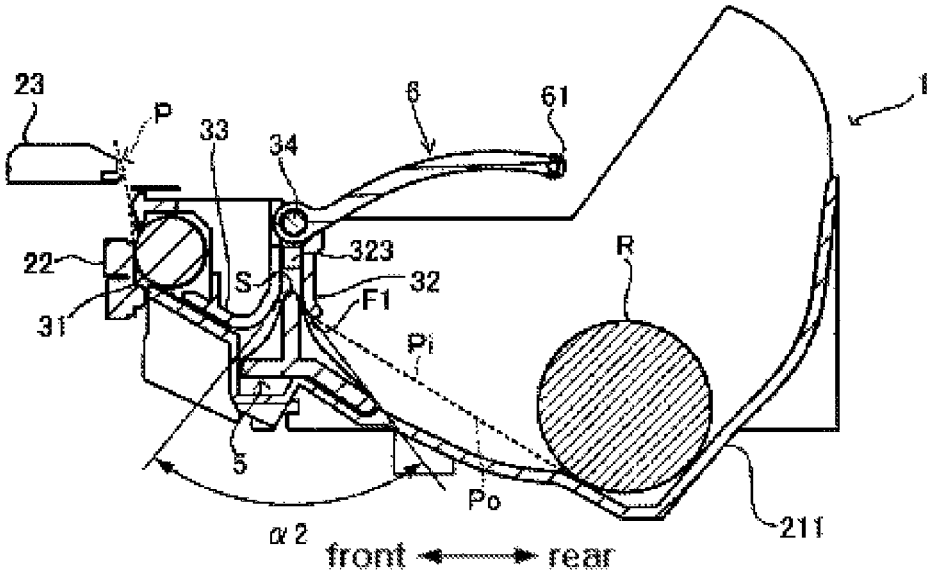

FIG. 5A and FIG. 5B respectively shows how the arm 6 is rotated in the clockwise direction according to the change in roll diameter where the ironing angle α is kept constant. FIG. 6A, FIG. 6B, and FIG. 6C respectively shows how the ironing angle α is varied according to the change in roll diameter. In the drawings, the printer 1 is viewed from the left side. The explanation of the rotating direction and the urging direction of the upstream-side guide 32 and the arm 6 is based on the view from the left side. The roll diameter of the roll paper R is gradually reduced. Paper P is shown in a broken line for discrimination against the components of the printer 1. The cutter unit 23 and the fixed blade 35 are disposed on the downstream side of the platen roller 31 and the printing head 22. The cutter unit 23 is provided with a movable blade 231 reciprocally movable with respect to the fixed blade 35.

The paper P drawn out from the roll paper R and pinched between the platen roller 31 and the printing head 22 is conveyed on the paper conveying path to be cut by the cutter unit into a piece of paper and discharged from the not-shown paper discharge port. The paper P is conveyed in the paper conveying direction toward the paper discharge port. As described above, the arm 6 is rotated on the shaft 34 in the clockwise direction to be brought into engagement with the upstream-side guide 32 as the roll diameter decreases. As the arm 6 is further rotated in the clockwise direction, the upstream-side guide 32 interlocked with the arm 6 is rotated in the clockwise direction against urging force of the first torsion spring 341 (FIG. 4).

FIG. 5A shows in a circle an enlarged view of the arm 6 and the upstream-side guide 32 before engagement. FIG. 5B shows in a circle an enlarged view of the arm 6 and the upstream-side guide 32 after engagement. The upstream-side guide 32 is provided with a receiving portion 321 on the shaft 34 side while the arm 6 is provided with an engaging portion 62 to be engaged with the receiving portion 321. The upstream-side guide 32 is further provided with a stopper 323 on the front side thereof.

In FIG. 5A, the roll diameter of the roll paper R is still the maximum and the engaging portion 62 of the arm 6 is not yet engaged with the receiving portion 321 of the upstream-side guide 32. The upstream-side guide 32 is urged in the counter-clockwise direction by the first torsion spring 341 (FIG. 4) to separate the first pressing part F1 from the paper P. The paper P is thereby bent at the ironing part S of the decurling unit 5, pressed from the one side by the second pressing part F2 of the downstream-side guide 33 and then pinched between the platen roller 31 and the printing head 22. The ironing angle α1 is preferably around 110 to 120 degrees. The ironing angle α1 over 120 degrees would weaken curl correction force while below 110 degrees would strengthen the force too much as to even cause a reverse curling. In the schematic drawings, the ironing angle α is not necessarily illustrated at the preferable angle. As the paper P is conveyed in the paper conveying direction, proper curl correction force according to the ironing angle α1 is applied to the paper P.

In FIG. 5B, as the roll diameter of the roll paper R is reduced and the arm 6 is rotated in the clockwise direction, the engaging portion 62 of the arm 6 is brought into 15 engagement with the receiving portion 321 of the upstream-side guide 32. The roll diameter at the time of the engagement may be referred to as an upper limit setting value. When the roll diameter reaches the upper limit setting value, the first pressing part F1 is still away from the paper P.

As the roll diameter of the roll paper R is further reduced and the arm 6 is further rotated in the clockwise direction, the upstream-side guide 32 interlocked with the arm 6 is rotated in the clockwise direction to bring the first pressing part F1 of the upstream-side guide 32 into contact with the inner surface Pi of the paper P as shown in FIG. 6A. The roll diameter at the time of the contact may be referred to as a contact setting value.

The roll paper R is displaced a little as the roll diameter decreases due to a slope of the paper supporting part 211. The ironing angle α1 is, however, kept substantially constant from when the roll diameter is the maximum in FIG. 5A to when the roller diameter is decreased to the contact setting value in FIG. 6A. When the roll diameter is the maximum or the upper limit setting value, the first pressing part F1 of the upstream-side guide 32 is not in contact with the inner surface Pi of the paper P and the paper P is therefore supported by two spots, specifically the second pressing part F2 of the downstream-side guide 33 and the ironing part S of the decurling unit 5. When the roll diameter is reduced to the contact setting value, the first pressing part F1 of the upstream-side guide 32 is brought into contact with the inner surface Pi of the paper P and the paper P is therefore supported by three spots, specifically the second pressing part F2 of the downstream-side guide 33, the ironing part S of the decurling unit 5, and the first pressing part F1 of the upstream-side guide 32. Curl correction force is greater when the paper P is supported by three spots at the contact setting value than by two spots at the maximum or the upper limit setting value even though the ironing angle α1 is kept constant. Curl correction force is adjustable by the number of paper supporting spots in addition to by the change in the ironing angle α. Further, a certain play is provided between the engagement of the arm 6 with the upstream-side guide 32 in FIG. 5B and the contact of the first pressing part F1 with the inner surface Pi in FIG. 6A. Even when the engagement of the arm 6 with the upstream-side guide 32 is displaced to some extent, the position where the first pressing part F1 is brought into contact with the inner surface Pi, which may be referred to as an ironing starting position, can be set to a target angle without difficulty.

The intensity of curl is weaker as the roll diameter is larger. Curl correction may be therefore not required as far as the roll diameter is as large as the predetermined size. The maximum roll diameter requiring curl correction may be set as the upper limit setting value. The operation of the first pressing part F1 may be stopped as far as the roll diameter is larger than the upper limit setting value. Curl correction force is thereby suppressed until the roll diameter reaches the upper limit setting value.

As the roll diameter is further decreased, the upstream-side guide 32 interlocked with the arm 6 is rotated in the clockwise direction to bring the first pressing part F1 of the upstream-side guide 32 into contact with the inner surface Pi of the paper P. The paper P is thereby pushed from the one side (FIG. 2) by the first pressing part F1. The ironing angle α is thereby reduced and correction force applied by the ironing part S is increased.

As the roll diameter is further decreased, the upstream-side guide 32 interlocked with the arm 6 is rotated in the clockwise direction to further reduce the ironing angle α. As shown in FIG. 6B, rotation of the upstream-side guide 32 is stopped when the stopper 323 thereof abuts against the downstream-side guide 33. The roll diameter at the time of the stop of rotation may be referred to as a lower limit setting value. During while the roll diameter is decreased from the contact setting value in FIG. 6A to the lower limit setting value in FIG. 6B, the ironing angle α1 is reduced to the the ironing angle α2 as the roll diameter decreased, thereby correction force applied to the paper S by the ironing part S is increased. The ironing angle α2 is preferably around 80 to 90 degrees. The ironing angle α2 over 90 degrees would possibly weaken correction force while under 80 degrees would increase the force too much.

The downstream-side guide 33 fixed to the platen holder 3 (FIG. 4) blocks the upstream-side guide 32 and the arm 6 to be rotated in the clockwise direction beyond the position of FIG. 6B. The ironing angle α2 is at the minimum at the lower limit setting value and remains unchanged even when the roll diameter is further reduced below the lower limit setting value. The ironing angle α2 is not changed while the roll diameter is decreased below the lower limit setting value in FIG. 6B, and correction force applied to the paper P by the ironing part S thereby remains constant. Though the intensity of curl is increased as the roll diameter is decreased, reducing the ironing angle α too much would possibly cause a problem of an excess of friction load on the paper P. Applying correction force than is needed would also cause a problem of reverse curling. In the invention, when the roll diameter is decreased below the lower limit setting value, movement of the first pressing part F1 is stopped, thereby preventing the problems of friction force and reverse curling. The ironing angle α may be adjustable according to flexibility, thickness or weight of paper and environmental conditions such as temperature and humidity.

In the printer 1 of the invention, the paper P is conveyed and printed under control of a printer control unit 70 comprising a microcomputer.

Figure 7:
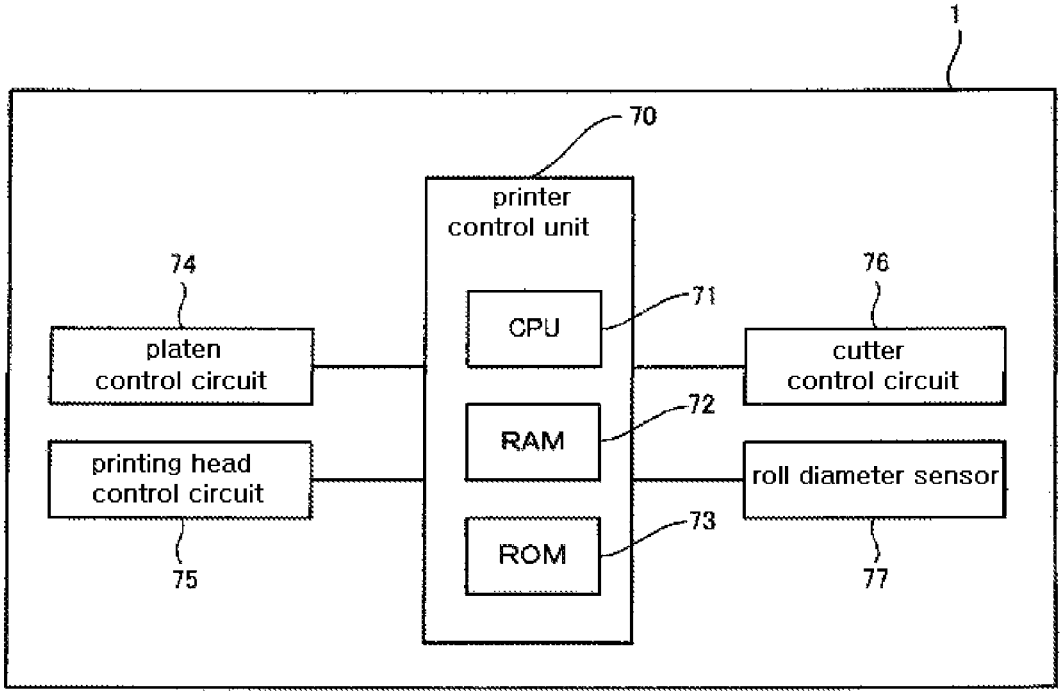
FIG. 7 is a block diagram of a circuit configuration of the printer of FIG. 3.

FIG. 7 is a block diagram of a circuit configuration of the printer 1 of FIG. 3.

The printer 1 is provided with the printer control unit 70 to which a platen control circuit 74, a printing head control circuit 75, a cutter control circuit 76, and a roll diameter sensor 77 are connected. The printer control unit 70 comprises a CPU (Central Processing Unit) 71, a RAM (Random Access Memory) 72, and a ROM (Read Only Memory) 73. The ROM 73 stores various programs including a platen control program, a printing head control program, and a cutter control program. The ROM 73 also stores corresponding data of the roll diameter of roll paper R and the forward rotating speed of the platen roller 31. The corresponding data experimentally defined beforehand is stored in one to one correspondence. The corresponding data is, for example, defined in a manner that the forward rotating speed of the platen roller 31 is reduced to lower the conveying speed as the roll diameter is decreased. The rotating speed of the platen roller 31 may be calculated based on the roll diameter in the case the relation therebetween can be defined by a formula.

The platen control circuit 74 is connected to the not-shown paper conveying motor for rotating the platen roller 31. The printing head control circuit 75 is connected to the printing head 22 (FIG. 5). The cutter control circuit 76 is connected to the cutter unit 23 (FIG. 5).

The platen control circuit 74 drives the paper conveying motor forwardly or reversely under control of the CPU 71 in accordance with the platen control program. When the motor is forwardly rotated, the platen roller 31 is forwardly rotated to convey the paper P in the conveying direction. When the motor is reversely rotated, the platen roller 31 is reversely rotated to convey the paper in the reverse direction opposite the forward direction.

The printing head control circuit 75 drives the printing head 22 to print numbers and letters on the paper P under control of the CPU 71 in accordance with the printing head control program. The printing head 22 selectively heats a plurality of elements under control of the CPU 71 to execute a printing on a portion of the paper P in contact with the heated elements.

The cutter control circuit 76 drives the movable blade 231 of the cutter unit 23 under control of the CPU 71 in accordance with the cutter control program. The movable blade 231 is operated to cut the paper in cooperation with the fixed blade 35.

The roll diameter sensor 77 detects the roll diameter of the roll paper R. A not-shown reflection sensor is provided on the side wall 212 of the paper accommodating part 21 (FIG. 3). A mechanical sensor may be used instead.

An operation of the printer 1 in accordance with a main program executed by the printer control unit 70 is being described.

The main program is started upon power-on of the printer 1. The CPU 71, in response to a printing order, drives the paper conveying motor to start rotation of the platen roller 31 and executes a printing on the paper P by the printing head 22. As the platen roller 31 is rotated, paper curl of the paper P is corrected at the ironing part S while conveyed in the conveying direction. As described above, as far as the roll diameter is between the contact setting value in FIG. 6A and the lower limit setting value in FIG. 6B inclusive, the ironing angle α is reduced to increase correction force as the roll diameter is decreased to increase the intensity of roll. The CPU 71 drives the paper conveying motor to rotate the platen roller 31 at the rotating speed determined by the corresponding data based on the roll diameter detected by the roll diameter sensor 77. Accordingly, the conveying speed is reduced to increase curl correction force as the roll diameter is decreased to increase the intensity of curl. Such adjustment of the ironing angle α and the conveying speed enables the curl correction force to be adjusted according to the intensity of curl.

The CPU 71 stops conveyance of the paper P upon completion of printing. The CPU 71 drives the movable blade 231 of the cutter unit 23 to cut the paper P into a piece of paper of predetermined length. In the case next conveyance is not resumed in a predetermined period after completion of conveyance, the CPU 71 drives the paper conveying motor to reversely rotate the platen roller 31, thereby reversely conveying the paper P. Such reverse conveyance may be triggered by every paper cutting.

Figure 8A:
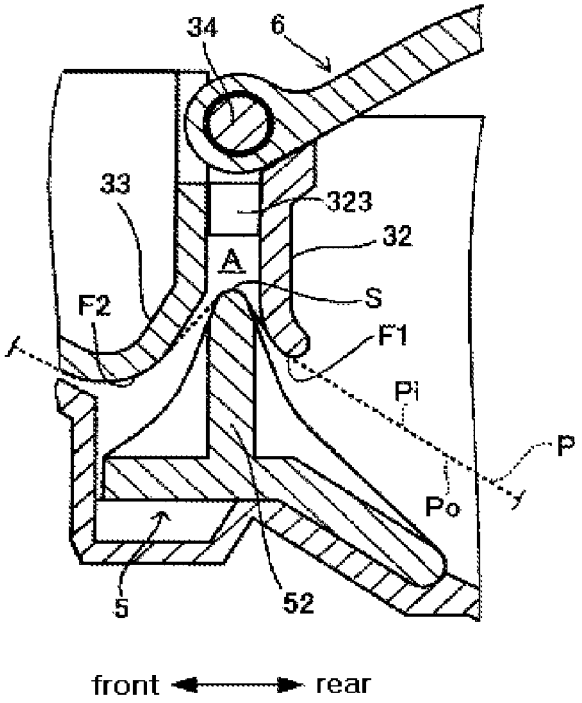
FIG. 8A is an enlarged view of a circled A portion in FIG. 6B.
Figure 8B:
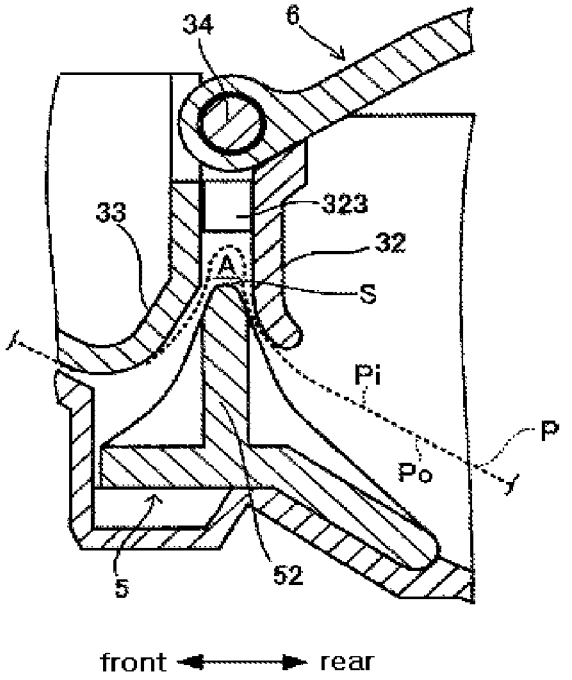
FIG. 8B shows reverse conveyance of the paper of FIG. 8A.

FIG. 8A is an enlarged view of a circled A portion in FIG. 6B. FIG. 8B shows reverse conveyance of the paper of FIG. 8A.

An accommodating space A is provided above the ironing part S of the decurling unit 5, specifically on the opposite side of the ironing part S with respect to the paper P. When the paper P is reversely conveyed from the state in FIG. 8A, the paper P including a portion in contact with the ironing part S is bent upward, thereby making a loop in the accommodating space A as shown in FIG. 8B. Tension applied to the paper P is thereby released and the paper P leaves the ironing part S. Bending tendency of the paper P is thereby prevented even when the standby condition continues.

A modified embodiment is being described regarding a peculiar feature. Any element common to the embodiment will have the common reference symbol and the explanation of which is being omitted as the case may be.

FIG. 9A, FIG. 9B, FIG. 10A, and FIG. 10B respectively show a first modified embodiment having a different configuration from the printer 1 of FIG. 5 and FIG. 6. The roll diameter is gradually reduced from FIG. 9A to FIG. 10B.

Figure 9A:
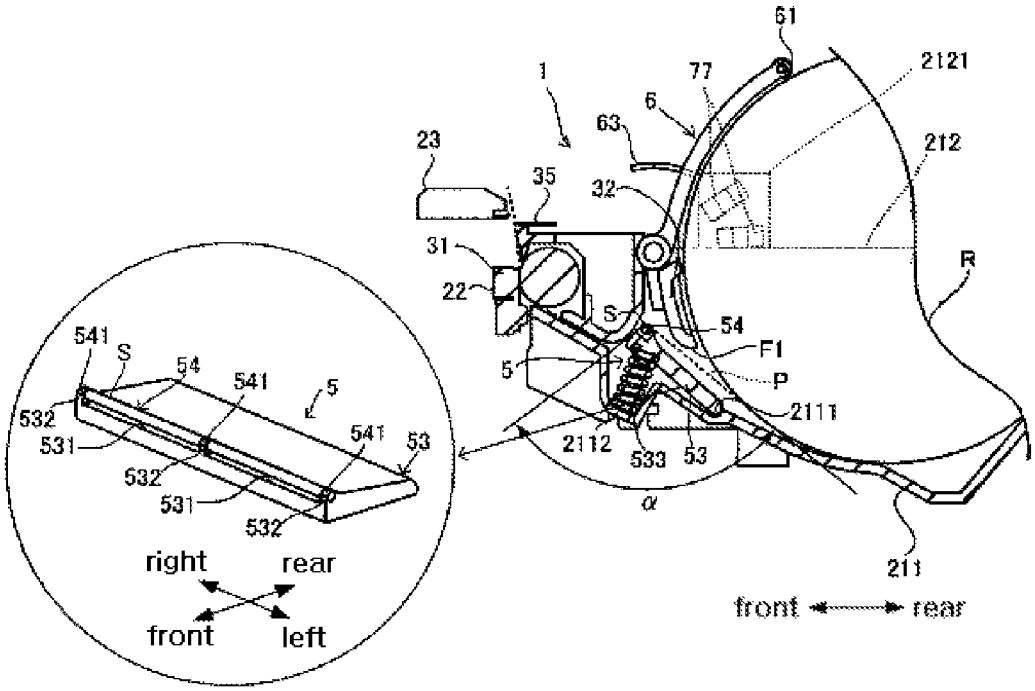
FIG. 9A and FIG. 9B respectively shows a first modified embodiment having a different configuration from the printer of FIG. 5 and FIG. 6.

The decurling unit 5 is provided with a damper 53 and a shaft 54 having the ironing part S. The damper 53 is provided with a spring 533. FIG. 9A shows in a circle an enlarged view of the damper 53 and the shaft 54 viewed from obliquely front left. The damper 53 is a horizontally long plate having a claw 532 at three horizontal positions (center and sides) respectively on the upper edge of the downstream (front) side thereof with a cutout 531 respectively provided between the claws 532. The shaft 54 is made of metal of 2 mm in diameter. The shaft 54 has a thinner portion 541 of 1.7 mm in diameter at the corresponding positions to the claws 532. The shaft 54 is rotatably mounted on the damper 53 by engagement of the thinner portions 541 with the claws 532. The shaft 54 may be fixed to the damper 53 on the right and left ends thereof via an E ring or others. The paper holder 2 is provided with a damper mounting part 2111 on the downstream side of the paper supporting part 211. The damper 53 is attached to the damper mounting part 2111 at the upstream-side end thereof by a not-shown hinge extended in the direction perpendicular to the paper surface. The damper 53 is thereby rotatably mounted on the damper mounting part 2111. The paper holder 2 is provided with a spring accommodating part 2112 for the spring 533 on the downstream side of the damper mounting part 2111. The damper 53 is urged toward the one side (FIG. 2) by the spring 533 and the shaft 54 having the ironing part S is thereby urged toward the one side. As the paper P is conveyed in the conveying direction, the damper 53 sinks according to the tension in the paper P in the conveying direction. The damper 53 sinks in a larger amount in a state of higher tension in the paper with the roll diameter being larger. The amount that the damper 53 sinks is decreased as the roll diameter is decreased and the tension in the paper is thereby decreased. The ironing angle $\alpha$ is thereby adjustable according to the diameter of the roll paper R. Conveyance burden possibly imposed by a larger roll diameter or generated at the start of conveyance is lightened, thereby preventing damage on the platen roller 31 and other driving members and reducing load on the conveying motor. The shaft 54 is rotatable with respect to the damper 53, suppressing wear of the shaft 54 and reducing friction load on the paper P.

A sensor board 2121 where the two roll diameter sensors 77 are mounted is provided at the upper part of the left side wall 212. The sensor board 2121 is attached to the side wall 212 in a manner that the roll diameter sensors 77 are positioned outside the side wall 212 with respect to the right and left direction, thereby preventing interference with the roll paper R. The roll diameter sensor 77 is a transmission type sensor. The arm 6 is provided with a shielding plate 63 on the right side edge thereof. The shielding plate 63 shields light between a projector and a receiver of the roll diameter sensors 77.

FIG. 9A shows a state of the roll diameter being at the maximum where the upstream-side pressing part F1 of the upstream-side guide 32 is not in contact with the paper P. As the paper P is conveyed in the conveying direction, the damper 53 sinks in a larger amount in response to higher tension in the paper P in the conveying direction due to back tension generated by the weight of the roll paper R, thereby increasing the ironing angle $\alpha$ and reducing the correction force applied to the paper P. Both of the roll diameter sensors 77 do not detect the shielding plate 63 and the conveying speed of the paper P is not changed.

Figure 9B:
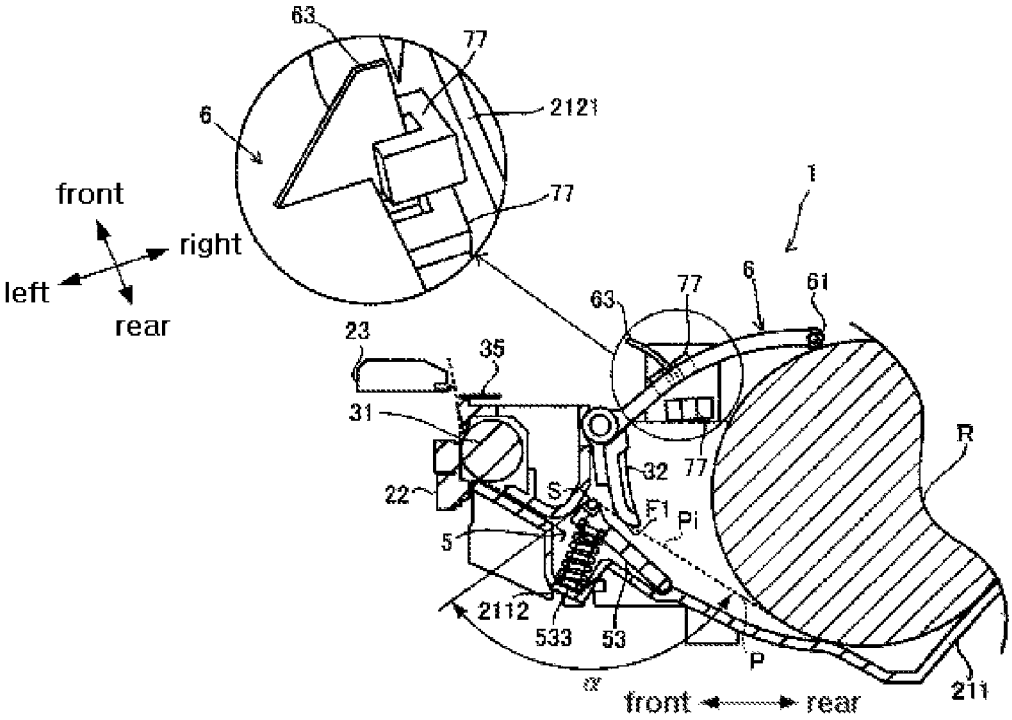

FIG. 9B shows a state of the roll diameter being decreased where the arm 6 is in engagement with the upstream-side guide 32. The upstream-side pressing part F1 of the upstream-side guide 32 is brought into contact with the inner surface Pi of the paper P as the arm 6 is rotated. As the paper P is conveyed in the conveying direction, the amount that the damper 53 sinks is decreased as the roll diameter is reduced and the tension in the paper is thereby decreased. The ironing angle $\alpha$ is thereby reduced and the correction force applied to the paper P is increased when compared with the state of FIG. 9A. One of the roll diameter sensors 77 is shielded by the shielding plate 63 of the arm 6. FIG. 9B shows in a circle an enlarged perspective rear view from obliquely left of a state in that a detection region of one of the roll diameter sensors 77 is shielded by the shielding plate 63. The shielded roll diameter sensor 77 is in a sensing state, reducing the conveying speed to some extent and thereby increasing the correction force to some extent.

Figure 10A:
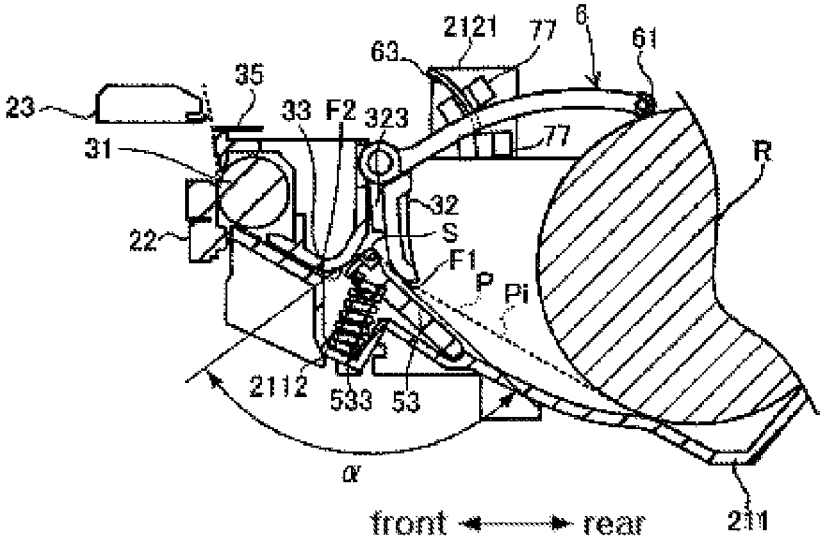
FIG. 10A and FIG. 10B respectively shows the first modified embodiment.

As the roll diameter is further reduced as shown in FIG. 10A, the upstream-side pressing part F1 of the upstream-side guide 32 presses the inner surface Pi of the paper P from the one side (FIG. 2) and the amount that the damper 53 sinks is further reduced as the paper P is conveyed. The ironing angle $\alpha$ is further reduced and the correction force is increased compared with the state of FIG. 9B. One of the sensors 77 remains in a sensing state and the conveying speed is thereby maintained.

Figure 10B:
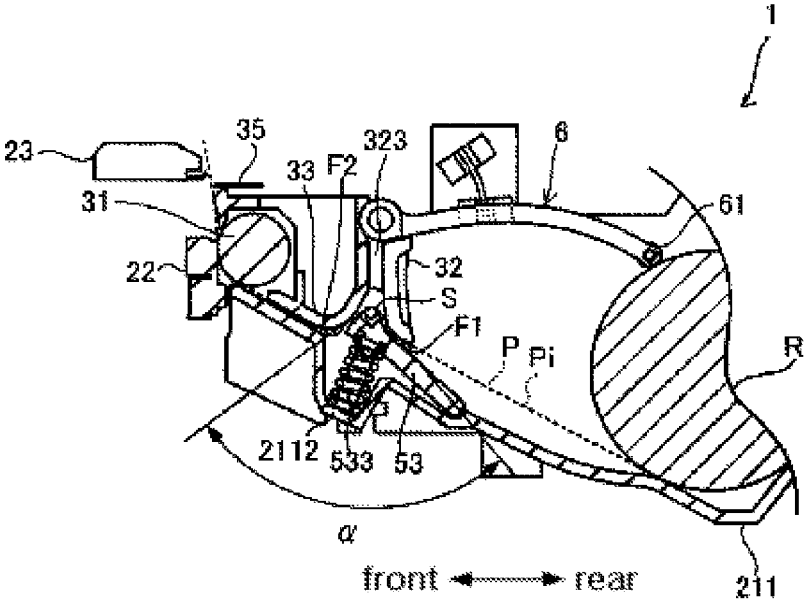

As the roll diameter is much further reduced as shown in FIG. 10B, the upstream-side pressing part F1 of the upstream-side guide 32 further presses the inner surface Pi of the paper P from the one side (FIG. 2) until the stopper 323 of the upstream-side guide 32 is brought into contact with the downstream-side guide 33. The amount that the damper 53 sinks is further reduced as the paper P is conveyed. The ironing angle $\alpha$ is further reduced and the correction force is further increased compared with the state of FIG. 10A. Both of the roll diameter sensors 77, being shielded by the shielding plate 63 of the arm 6, are brought into a sensing state. The conveying speed is further reduced and the correction force is further increased. In the embodiment, the two roll diameter sensors 77 are used to vary the conveying speed in three ways. A single roll diameter sensor may be used to vary the conveying speed in two ways or three or more diameter sensors may be used to vary the conveying speed in four or more ways.

Figure 11A:
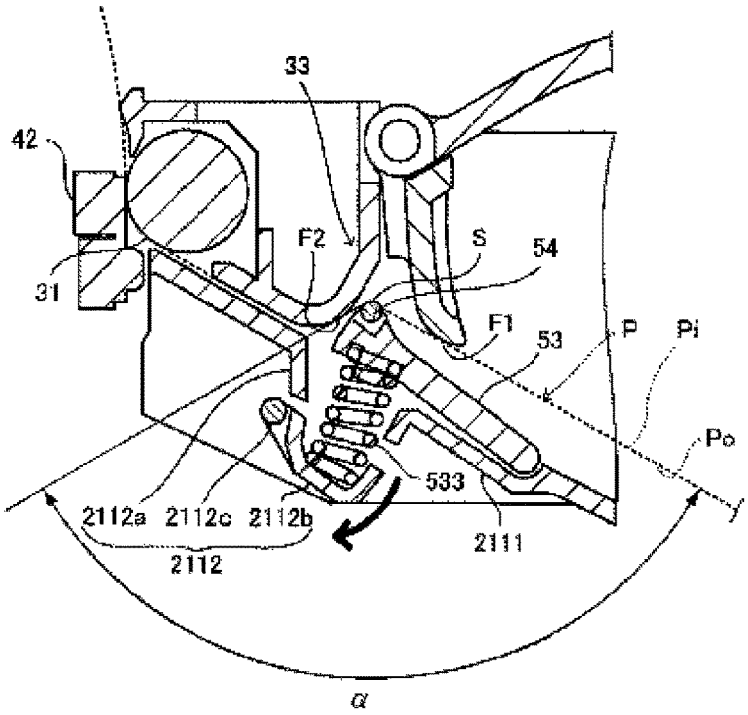
FIG. 11A and FIG. 11B respectively shows a second modified embodiment having another configuration of a spring accommodating part of FIG. 9 and FIG. 10.
Figure 11B:
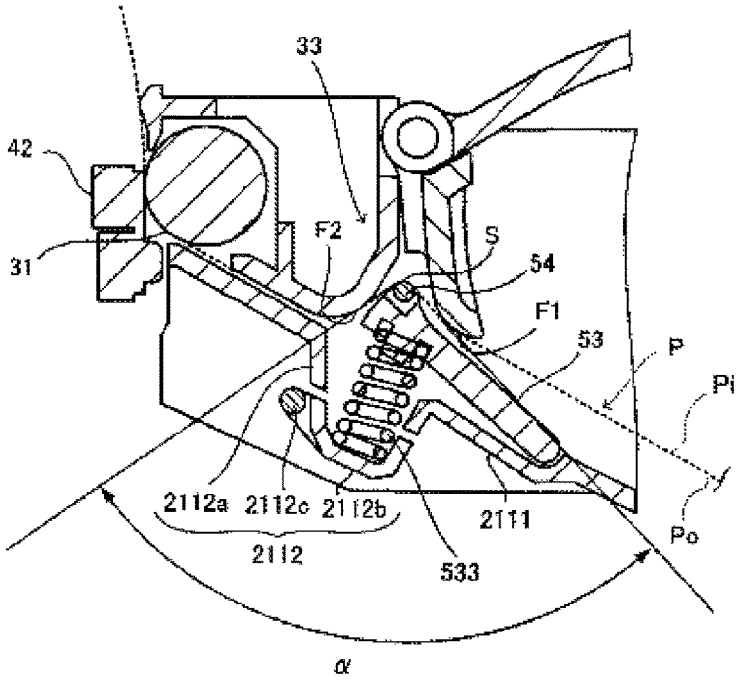

FIG. 11A and FIG. 11B respectively shows a second modified embodiment of the invention having another configuration of the spring accommodating part 2112.

The spring accommodating part 2112 has a wall 2112*a* and a spring receiving bottom 2112*b* as shown in FIG. 11A. The spring receiving bottom 2112*b* is rotatably mounted at the bottom end of the wall 2112*a* by a hinge 2112*c* extended in the direction perpendicular to the paper surface. An upstream-end portion of the spring receiving bottom 2112*b* is rotatable in the clockwise direction on the hinge 2112*c* as shown in a bold arc arrow. The spring 533 is thereby stretched downward with the lower end thereof downward, weakening the urging force and facilitating the sinking of the damper 533. The ironing angle α is thereby increased to weaken the correction force even in the case tension applied to the conveyed paper is the same. The ironing angle α is around 90 degrees in FIG. 11A while increased up to around 115 degrees in FIG. 11B. In addition to the adjustment according to the roll diameter, correction force is further finely adjustable by moving the lower end of the spring 533 downward according to paper thickness (thick or thin), paper types, and the intensity of curl influenced by environmental conditions such as temperature and humidity. The spring receiving bottom 2112*b* may be manually rotated by a lever or others or may be solenoid-driven.

As described above, the paper conveyance mechanism 10 or the printer 1 is capable of correcting the curl of paper drawn out from the roll paper according to the intensity of curl.

The invention may be embodied in various forms without departing from the scope of the invention defined by the claims. For example, the paper P may be drawn out from the upper side of the roll paper R and the ironing part S may be urged downward. Only one of the upstream-side pressing part F1 and the downstream-side pressing part F2 may be provided. The upstream-side pressing part F1 and the downstream-side pressing part F2 may be constituted by a rotatable shaft as the ironing part is.

Any element included in only one of the embodiment or the modifications may be applied in the other embodiment or the modifications.

What is claimed is:

1. A paper conveyance mechanism capable of conveying paper in a conveying direction, drawn out from a roll paper formed by a long continuous paper wound in a roll shape with an inside surface of the paper on one side and another outside surface of the paper on the other side, comprising:

an ironing part for correcting paper curl which is brought into contact with the outside surface of the paper while the paper is conveyed;

a pressing part which presses the inside surface of the paper to bend the paper at the ironing part; and an arm engaged with an outer circumferential surface of the roll paper to be operated according to a change in a roll paper diameter of the roll paper, wherein, when the roll paper diameter is above an upper limit setting value, the pressing part is kept stationary and keeping out of contact with the paper even when the arm is operated; and wherein at least when the roll paper diameter is a certain value in a certain range below the upper limit setting value, the pressing part moves in a direction from the one side toward the other side in association with an operation of the arm while keeping in contact with the paper to reduce an interior angle formed in the paper in a bent state at the ironing part according to a decrease in the roll paper diameter.

2. The paper conveyance mechanism of claim 1, wherein the pressing part stops moving when the roll paper diameter is below a lower limit setting value, which is smaller than the upper limit setting value.

3. The paper conveyance mechanism of claim 2, wherein the pressing part moves in a direction from the one side toward the other side in association with the operation of the arm with keeping in contact with the paper to reduce the interior angle according to the decrease in the roll paper diameter, when the roll paper diameter is equal to or less than a contact setting value, and when the roll paper diameter is equal to or more than the lower limit setting value, wherein the contact setting value is a value below the upper limit setting value.

4. The paper conveyance mechanism of claim 3, wherein the arm is provided with an engaging portion, the pressing part is provided with a receiving portion which is engageable with the engaging portion, and the engaging portion is brought into engagement with the receiving portion when the arm is operated according to the change in the roll paper diameter.

5. The paper conveyance mechanism of claim 4, wherein the upper limit setting value is set to be the roll paper diameter at a moment when the engaging portion is engaged with the receiving portion.

6. The paper conveyance mechanism of claim 5, wherein the arm is urged in a direction to be operated according to the change in the roll paper diameter, and the pressing part is urged in a direction away from the paper.

7. The paper conveyance mechanism of claim 4, wherein the arm is urged in a direction to be operated according to the change in the roll paper diameter, and the pressing part is urged in a direction away from the paper.

8. The paper conveyance mechanism of claim 3, wherein the arm is urged in a direction to be operated according to the change in the roll paper diameter, and the pressing part is urged in a direction away from the paper.

9. The paper conveyance mechanism of claim 2, wherein the arm is provided with an engaging portion, the pressing part is provided with a receiving portion which is engageable with the engaging portion, and the engaging portion is brought into engagement with the receiving portion when the arm is operated according to the change in the roll paper diameter.

10. The paper conveyance mechanism of claim 9, wherein the upper limit setting value is set to be the roll paper diameter at a moment when the engaging portion is engaged with the receiving portion.

11. The paper conveyance mechanism of claim 10, wherein the arm is urged in a direction to be operated according to the change in the roll paper diameter, and the pressing part is urged in a direction away from the paper.

12. The paper conveyance mechanism of claim 9, wherein the arm is urged in a direction to be operated according to the change in the roll paper diameter, and the pressing part is urged in a direction away from the paper.

13. The paper conveyance mechanism of claim 2, wherein the arm is urged in a direction to be operated according to the change in the roll paper diameter, and the pressing part is urged in a direction away from the paper.

14. The paper conveyance mechanism of claim 1, wherein the arm is provided with an engaging portion, the pressing part is provided with a receiving portion which is engageable with the engaging portion, and the engaging portion is brought into engagement with the receiving portion when the arm is operated according to the change in the roll paper diameter.

15. The paper conveyance mechanism of claim 14, wherein the upper limit setting value is set to be the roll paper diameter at a moment when the engaging portion is engaged with the receiving portion.

16. The paper conveyance mechanism of claim 15, wherein the arm is urged in a direction to be operated according to the change in the roll paper diameter, and the pressing part is urged in a direction away from the paper.

17. The paper conveyance mechanism of claim 14, wherein the arm is urged in a direction to be operated according to the change in the roll paper diameter, and the pressing part is urged in a direction away from the paper.

18. The paper conveyance mechanism of claim 1, wherein the arm is urged in a direction to be operated according to the change in the roll paper diameter, and the pressing part is urged in a direction away from the paper.

19. A paper conveyance mechanism capable of conveying paper in a conveying direction, drawn out from a roll paper formed by a long continuous paper wound in a roll shape with an inside surface of the paper on one side and another outside surface of the paper on the other side, comprising:

an ironing part for correcting paper curl which is brought into contact with the outside surface of the paper while the paper is conveyed;

a pressing part which presses the inside surface of the paper to bend the paper at the ironing part; and an arm engaged with an outer circumferential surface of the roll paper to be operated according to a change in a roll paper diameter of the roll paper, wherein, when the roll paper diameter is above an upper limit setting value, the pressing part is kept stationary and keeping out of contact with the paper even when the arm is operated; and wherein at least when the roll paper diameter is a certain value in a certain range below the upper limit setting value, the pressing part moves in a direction from the one side toward the other side in association with an operation of the arm while keeping in contact with the paper to reduce an interior angle formed in the paper in a bent state at the ironing part according to a decrease in the roll paper diameter, wherein the arm is provided with an engaging portion, the pressing part is provided with a receiving portion which is engageable with the engaging portion, and the engaging portion is brought into engagement with the receiving portion when the arm is operated according to the change in the roll paper diameter.

20. The paper conveyance mechanism of claim 19, wherein the upper limit setting value is set to be the roll paper diameter at a moment when the engaging portion is engaged with the receiving portion.

* * * * *